United States Patent [19]

Chen et al.

[11] 4,111,760

[45] Sep. 5, 1978

[54] METHOD AND ELECTROLYTE FOR THE ELECTRODEPOSITION OF COBALT AND COBALT-BASE ALLOYS IN THE PRESENCE OF AN INSOLUBLE ANODE

[75] Inventors: Edward S. Chen; John C. Sadak, both of Clifton Park; G. Raman Lakshminarayanan, Latham, all of N.Y.

[73] Assignee: The United States of America as represented by the Secretary of the Army, Washington, D.C.

[21] Appl. No.: 842,766

[22] Filed: Oct. 17, 1977

Related U.S. Application Data

[63] Continuation-in-part of Ser. No. 736,901, Oct. 29, 1976, abandoned.

[51] Int. Cl.[2] ..... C25D 3/12; C25D 3/56; C25D 5/02; C25D 7/04

[52] U.S. Cl. ..... 204/26; 204/43 T; 204/48

[58] Field of Search ..... 204/26, 43 T, 48, 112, 204/123

[56] References Cited

U.S. PATENT DOCUMENTS

| | | | |
|---|---|---|---|
| 1,886,218 | 11/1932 | Olin et al. | 204/26 X |
| 2,599,178 | 6/1952 | Holt et al. | 204/43 T |
| 2,653,127 | 9/1953 | Brenner et al. | 204/43 T |

FOREIGN PATENT DOCUMENTS

| | | | |
|---|---|---|---|
| 333,222 | 4/1972 | U.S.S.R. | 204/43 T |

*Primary Examiner*—G. L. Kaplan
*Attorney, Agent, or Firm*—Nathan Edelberg; Harold H. Card, Jr.; A. Victor Errkila

[57] ABSTRACT

The formation of insoluble oxide precipitates during the electrodeposition of cobalt and cobalt-base alloys from an acidic aqueous cobalt sulfate electrolyte in the presence of an insoluble anode is suppressed by adding the salt or oxide of a metal selected from the group consisting of vanadium, titanium, and molybdenum. While the additive participates in the electrochemical activity occurring at both the anode and the cathode, there is no codeposition thereof with the electroplated metal or metals.

8 Claims, No Drawings

METHOD AND ELECTROLYTE FOR THE ELECTRODEPOSITION OF COBALT AND COBALT-BASE ALLOYS IN THE PRESENCE OF AN INSOLUBLE ANODE

The invention described herein may be manufactured, used, and licensed by or for the Government for Governmental purposes without the payment to us of any royalties thereon.

The present invention is a continuation-in-part of our co-pending application, Ser. No. 736,901, filed on Oct. 29, 1976 and now abandoned.

BACKGROUND OF THE INVENTION

This invention relates to the electroplating of cobalt and cobalt base alloys on metal substrates and is more particularly directed to an improved electrolyte therefor which will suppress or inhibit the formation of undesirable precipitates in the presence of an insoluble or passive anode.

Certain critical areas of the interior bore surfaces of gun tubes are customarily coated with a layer of chromium plating to protect against the erosion and wear encountered during the firing of projectiles therethrough. Recent investigation of other plating materials has demonstrated that even greater protection is afforded by a coating of cobalt or an alloy of cobalt and iron. However, while chromium can be successfully electroplated by techniques which utilize an insoluble or passive anode, such is not the situation in regard to the deposition of cobalt and iron since the particular chemistry involved produces insoluble oxide precipitates which not only interfere with the efficiency of the plating process but are also codeposited with the desired metals to the detriment of the mechanical and physical properties thereof. Although these difficulties can be partially avoided by the employment of an appropriate soluble anode within the gun tube, the continuous dimensional change in the diameter thereof during the depletion of the plating metal therefrom complicates the desired attainment of a deposit of uniform thickness. Consequently, the electroplating of cobalt and cobalt base alloys on the interior bore surfaces of gun tubes has heretofore been limited to those sizes in which the bore diameters thereof are 20mm or larger.

It is therefore an object of the present invention to provide an improved method for electroplating a layer of cobalt or an alloy thereof on the interior bore surfaces of metal tubes at ambient temperatures to provide a corrosion-resistant ductill coating thereon. Ambient temperatures are normally room temperatures in the vicinity of 20° C.

It is another object of this invention to provide an electroplating method, as aforesaid, which will produce cobalt and cobalt-iron deposits of uniform thickness even in gun tubes with bore diameters of less than 20mm in size.

A further object of this invention is to provide an electroplating method, as aforesaid, wherein the electrolyte therefor includes an additive capable of inhibiting or suppressing the formation of the undesirable cobalt and iron oxides heretofore produced in the presence of an insoluble or passive anode.

Still another object of this invention lies in the provision of an electrolyte, as aforesaid, wherein the additive participates in the electrochemical activity occurring at both the anode and the cathode and yet is not codeposited with the electroplated metals.

These and other objects will become apparent from the following detailed description and claims.

SUMMARY OF THE INVENTION

It has been found that the foregoing objects can best be achieved by carrying out the electroplating from a 1-molar concentration of aqueous cobalt sulfate electrolyte maintained at a nominal pH of 1.0 to which has been added the salt or oxide of a metal selected from the group consisting of vanadium, titanium, and molybdenum. When a solution of this type is electrolyzed in the presence of an insoluble anode, such as platinum, the preferred additive of vanadium pentoxide ($V_2O_5$) forms ions which interact with the trivalent cobalt ions to effect the reduction thereof to the bivalent ions which are, in turn, readily reducible to elemental metal at the cathode. Because of its position in the electromotive series, vanadium cannot be electrodeposited from an acid media. Consequently, the reduction of the vanadium ions at the cathode is counterbalanced by the subsequent oxidation thereof at the anode together with the continuing interaction between the vanadium and the trivalent cobalt ions. Such simultaneous electrochemical activity maintains a balance of the additive ions in the various oxidation states thereof during the cyclic electroplating process. Thus, because these additive metals are not consumed or codeposited, they can be considered as catalysts. In the event a cobalt-iron alloy is to be plated, the vanadium ions will not only prevent the formation of ferric oxide ($Fe_2O_3$) in the anode region but also serve to reduce the quantity of the ferric ions in the vicinity of the cathode to thereby prevent the codeposition of ferric hydroxide ($Fe(OH)_3$) which would otherwise increase the plating stress and lead to a relatively brittle deposit.

DESCRIPTION OF THE INVENTION

In order to achieve maximum catalytic action from the foregoing metallic additives, the cobalt is deposited from an aqueous cobalt sulfate solution of 1-molar concentration to which sufficient sulfuric acid ($H_2SO_4$) is added to bring the pH down to a nominal value of 1.0. The solution is prepared by dissolving 280 grams/liter of cobalt sulfate ($CoSo_4.7H_20$) in water and also includes boric acid ($H_3BO_3$) in a concentration of about 30 grams/liter to stabilize the pH at the desired value. However, satisfactory plating is also achieved with an electrolyte wherein the concentration of the cobalt sulfate ranges from 250–450 grams/liter, the boric acid concentration rises as high as 40 grams/liter, and the sulfuric acid addition provides a pH of up to 2.0 When iron is to be deposited along with the cobalt, the former is added to the electrolyte in the corresponding sulfate form in the particular concentration which will produce the desired alloy ratio between the cobalt and the iron. The relationship between the concentration of iron in the electrolyte and the percentage of iron desired in the plating deposit can be readily calculated by the formula % Fe deposit = 0.416 C where C is the concentration of the iron salt in grams/liter. In order to provide a satisfactory deposit, the alloy should possess an iron content of from 0.83–12.5% by weight and such range is provided when from 2–30 grams of ferrous sulfate ($FeSo_4.7\ H_2O$) is added to each liter of cobalt sulfate solution. But where a deposit of maximum ductility is desired, the iron therein is preferably limited to 9–11% by weight to provide a face centered cubic structure at all temperatures up to the melting point of the alloyed metal. Such limitation is achieved when the electrolyte is formulated from the following composition:

| | |
|---|---|
| $CoSO_4 \cdot 7\ H_2O$ | 383 grams/liter |
| $FeSO_4 \cdot 7\ H_2O$ | 21–26 grams/liter |
| $H_3BO_3$ | 30 grams/liter |
| $H_2SO_4$ | sufficient to provide a pH of 1.0 |

It has been found that the best deposition of both cobalt and iron from these electrolytes is achieved with an insoluble anode fabricated of platinum and various substrate metals dimensioned to provide a 2:1 cathode to anode ratio. It was also found desirable to plate at temperatures from about 20° C. to 60° C. at a current density ranging from 2–10 amps/sq. decimeter. However, increasing the minimum electrolysis temperature to 40° C. will improve the plating efficiency as well as the optimum physical properties of the end product.

In the past, the electroplating of cobalt and cobaltiron alloys on the interior bore surfaces of gun tubes has generally been limited to those of larger diameter (20mm or greater) due to the dimensional changes incurred during the rapid and frequently erratic depletion of the soluble anode. When electric current is passed through a conventional cobalt sulfate electrolyte, $Co^{2+}$ ions are produced which are eventually reduced to form a deposit of pure cobalt at the cathode. However, when the soluble anode was replaced by an insoluble anode in an effort to improve the uniformity of the cobalt plating within a gun tube having a bore diameter less than 20mm, the resulting plating was highly unsatisfactory both as to appearance and ductility. It was found that the presence of the insoluble anode in the electrolyte resulted in the excessive discharge of oxygen at the anode according to the reaction $2H_2O \rightarrow 4H^+ + O^2\nearrow + 4e^-$ and this together with the presence of $Co^{3+}$ ions lead to the formation of the black cobalt oxide ($Co_2O_3$) particles which codeposit with the cobalt to the detriment of the desired ductility thereof.

However, when a salt or oxide of such multivalent metals as vanadium, titanium, and molybdenum is added to the electrolyte of the present invention, the electrolysis products thereof interact with the $Co^{3+}$ ions to produce the soluble $Co^{2+}$ ions which are readily reduced to the desired Co at the cathode. While titanium and molybdenum additives are equally effective because they do not codeposit in the particular electrolytes involved in the deposition of cobalt, vanadium pentoxide ($V_2O_5$) is preferred in view of the lower cost and ready availability thereof. Upon the addition of from 2.3–4.3 grams/liter to the electrolytic solution, the $V_2O_5$ dissolves to form $VO_2^+$ ions in accordance with the reaction $V_2O_5 + 2H^+ \rightarrow 2VO_2^+ + H_2O$. During electrolysis, the majority of the $VO_2^+$ ions are reduced to $V^{2+}$, $V^{3+}$ and $VO^{2+}$ at the cathode in accordance with the particular applied potential and solution pH. These lower oxidation state ions interact with the $Co^{3+}$ ions to form the more stable $Co^{2+}$ ions in accordance with the reactions $V^{3+} + Co^{3+} \rightarrow Co^{2+} + VO^{2+}$ and $V^{2+} + Co^{3+\lambda} \rightarrow Co^{2+} + V^{3+}$. As shown in Table I below, a concentration of 2.8 grams of $V_2O_5$ per liter of electrolyte is required to completely suppress the formation of $Co_2O_3$ particles. However, because the buildup of the $Co^{3+}$ ions and $Co_2O_3$ is dependent on the length of time of the electrolysis process, a concentration of 4.3 grams per liter is actually required to completely suppress any formation of the undesirable $Co_2O_3$.

TABLE

| Concentration of $V_2O_5$ in grams/liter | Concentration of $Co^{3+}$ ions in moles/liter | Concentration of $Co_2O_3$ in grams/liter | Duration of electolysis in hours |
|---|---|---|---|
| 0 | $1.20 \times 10^{-3}$ | 0.07 | 0.5 |
| 0 | $5.50 \times 10^{-3}$ | 0.44 | 5.5 |
| 1.0 | $1.60 \times 10^{-3}$ | 0.08 | 3.5 |
| 2.3 | $0.56 \times 10^{-3}$ | trace | .5 |
| 2.3 | $1.04 \times 10^{-3}$ | 0.025 | 5.5 |
| 2.8 | $.90 \times 10^{-3}$ | .00 | 3.5 |
| 4.3 | 0 | .00 | 8.0 |

While Table I clearly shows the suppressive effect of various concentrations of $V_2O_5$ on the formation of $Co^{3+}$ ions and the consequent $Co_2O_3$ particles, the additive is equally effective in suppressing the formation of $Fe_2O_3$ which can form at the anode, during cobalt-iron alloy plating. However, unlike the pure cobalt electrolyte, the addition of $V_2O_5$ to the electrolyte containing iron will oxidize the $Fe^{2+}$ ions to the ferric state where it is stablized by the vanadium ions. Both the formation of $Fe_2O_3$ in the anolyte region and $Fe(OH)_3$ in the catholyte region are suppressed by the reductive activity of the vanadium ions thereby resulting in electrodeposits of improved appearance and ductility at a lower temperature than previously required.

The 2.3–4.3 grams/liter of vanadium pentoxide shown in Table I is the equivalent of 1.3–2.4 grams/liter of vanadium ions. It should be understood that titanium and molybdenum are equally operable additives in the same ionic concentration.

The foregoing disclosure and description of this invention is illustrative only. Various changes may be made within the scope of the appended claims without departing from the spirit of the invention.

I claim:

1. A method for electroplating cobalt on the interior surfaces of a metallic tubular cathode having a bore diameter of less than 20mm, comprising the steps of, preparing an electrolyte consisting of from 250–450 grams/liter of cobalt sulfate in aqueous solution, sufficient sulfuric acid to provide a pH ranging from 1.0–2.0 in value, and about 30–40 grams/ liter of boric acid for stabilizing the pH, adding to the electrolyte a sufficient quantity of the salt or oxide of the metal selected from the group consisting of vanadium, titanium, and molybdenum to provide a concentration of 1.3–2.4 grams/liter of corresponding metallic ions, and electrolyzing the resulting solution by the passage of from 2–10 amperes per square decimeter at a temperature from about 20° C. to 60° C. in the presence of an insoluble anode to produce a cobalt deposit of uniform thickness.

2. The method described in claim 1 wherein the insoluble anode is fabricated of platinum.

3. The method described in claim 1 wherein the additive to the electrolyte is vanadium in the pentoxide form thereof.

4. A method for electroplating cobalt on the interior surfaces of a metallic tubular cathode having a bore diameter of less than 20mm, comprising the steps of, preparing an electrolyte consisting of a 1-molar concentration (280 grams/liter) of cobalt sulfate in aqueous solution, sufficient sulfuric acid to provide a nominal pH of 1.0, and about 30 grams/liter of boric acid for stabilizing the pH, adding to the electrolyte sufficient vanadium pentoxide to provide a concentration of 1.3–2.4 grams/-liter of metallic ions, and electrolyzing the resulting solution by the passage of about 2–10 amperes per square decimeter at a temperature from about 20° C. to 60° C. in the presence of an insoluble anode to produce a cobalt deposit of uniform thickness.

5. A method for electroplating a cobalt-iron alloy on the interior surfaces of a metallic tubular cathode having a bore diameter of less than 20mm, comprising the steps of, preparing an aqueous electrolyte consisting of 250–450 grams/liter of cobalt sulfate, from 2–30 grams/ liter of ferrous sulfate, sufficient sulfuric acid to provide a pH ranging from 1.0–2.0 in value, and from 30–40 grams/liter of boric acid for stabilizing the pH, adding to the electrolyte a sufficient quantity of the salt or oxide of the metal selected from the group consisting of vanadium, titanium, and molybdenum to provide a concentration of 1.3–2.4 grams/liter of metallic ions, and electrolyzing the resulting solution by the passage of from 2–10 amperes per square decimeter at a temperature between 40° C.–60° C. in the presence of an insoluble anode to produce a cobalt-iron alloy deposit of uniform thickness wherein the percentage of iron therein is linearly proportional to the concentration of the ferrous sulfate in the electrolyte.

6. The method defined in claim 5 wherein the cobalt sulfate is limited to about 383 grams/liter and the ferrous sulfate is limited to 21–26 grams/liter to produce a cobaltiron alloy with 9–11% weight of iron for attainment of maximum ductility.

7. An electrolyte for electroplating cobalt on the interior bore surfaces of steel tubes, consisting essentially of, from 250–450 grams/liter of cobalt sulfate in aqueous solution, sufficient sulfuric acid to provide a pH ranging from 1.0–2.0 in value at a temperature from about 40° C. to 60° C., from 30–40 grams/liter of boric acid for stabilizing the pH, and from 2.3–4.3 grams/liter of an additive metallic salt or oxide selected from the group consisting of vanadium, titanium, and molybdenum salts and oxides to provide from 1.3–2.4 grams/liter of corresponding metallic ions.

8. An aqueous electrolyte for electroplating a cobaltiron alloy on the interior surfaces of steel tubes, consisting essentially of, from 250–450 grams/liter of cobalt sulfate, from 2–30 grams/liter of ferrous sulfate, sufficient sulfuric acid to provide a pH ranging from 1.0–2.0 in value at a temperature between 40° C.–60° C., from 30–40 grams/liter of boric acid for stabilizing the pH, and from 2.3–4.3 grams/liter of an additive metallic salt or oxide selected from the group consisting of vanadium, titanium, an molybdenum salts and oxides to provide from 1.3–2.4 grams/liter of corresponding metallic ions.

* * * * *